US009128439B2

(12) United States Patent
Miyadera et al.

(10) Patent No.: US 9,128,439 B2
(45) Date of Patent: Sep. 8, 2015

(54) IMAGE FORMING APPARATUS AND CONVEYANCE CONTROL METHOD

(71) Applicants: Tatsuya Miyadera, Kanagawa (JP); Akinori Yamaguchi, Osaka (JP); Masatoshi Murakami, Osaka (JP)

(72) Inventors: Tatsuya Miyadera, Kanagawa (JP); Akinori Yamaguchi, Osaka (JP); Masatoshi Murakami, Osaka (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/093,740

(22) Filed: Dec. 2, 2013

(65) Prior Publication Data

US 2014/0153943 A1 Jun. 5, 2014

(30) Foreign Application Priority Data

Dec. 3, 2012 (JP) ..... 2012-264730
Dec. 3, 2012 (JP) ..... 2012-264777
Dec. 3, 2012 (JP) ..... 2012-264778

(51) Int. Cl.
*G03G 15/00* (2006.01)
*G03G 15/01* (2006.01)

(52) U.S. Cl.
CPC ..... *G03G 15/5062* (2013.01); *G03G 15/01* (2013.01); *G03G 15/5058* (2013.01)

(58) Field of Classification Search
CPC ..... G03G 15/5054; G03G 15/5058; G03G 15/5062
USPC ..... 399/49, 388
See application file for complete search history.

(56) References Cited

U.S. PATENT DOCUMENTS

2006/0140650 A1* 6/2006 Yokote ..... 399/27
2008/0069602 A1 3/2008 Miyadera
2008/0130030 A1 6/2008 Okunishi et al.
2008/0292369 A1* 11/2008 Takezawa ..... 399/301
2009/0060599 A1* 3/2009 Sano et al. ..... 399/301
2010/0232817 A1 9/2010 Miyadera et al.
2010/0239331 A1 9/2010 Miyadera et al.

(Continued)

FOREIGN PATENT DOCUMENTS

JP 10-148992 6/1998
JP 2003-307901 10/2003

(Continued)

OTHER PUBLICATIONS

U.S. Appl. No. 13/919,261, filed Jun. 17, 2013.

*Primary Examiner* — G.M. Hyder
*Assistant Examiner* — Thomas Giampaolo, II
(74) *Attorney, Agent, or Firm* — Harness, Dickey & Pierce, P.L.C.

(57) ABSTRACT

An image forming apparatus including: a conveyance mechanism conveying a first pattern formed by a first image forming unit among image forming units, a second pattern formed by a second image forming unit among the image forming units; a detection unit detecting the first pattern and the second pattern; and a control unit controlling, when a first condition is satisfied, a timing of conveying a recording sheet having the image formed by the first image forming unit is transferred based on a first time required after the formation of the first pattern and before detecting the first pattern, and controlling, when a second condition is satisfied, a timing of conveying the recording sheet having the image formed by the second image forming unit is transferred based on a second time required after the formation of the second pattern and before detecting the second pattern.

20 Claims, 11 Drawing Sheets

(56) References Cited

U.S. PATENT DOCUMENTS

| | | | | |
|---|---|---|---|---|
| 2010/0247124 | A1* | 9/2010 | Aoki et al. | 399/49 |
| 2011/0026082 | A1 | 2/2011 | Miyadera et al. | |
| 2011/0228029 | A1 | 9/2011 | Miyadera et al. | |
| 2011/0228364 | A1 | 9/2011 | Miyadera et al. | |
| 2011/0229172 | A1 | 9/2011 | Miyadera et al. | |
| 2012/0062681 | A1 | 3/2012 | Miyadera et al. | |
| 2012/0207498 | A1 | 8/2012 | Miyadera et al. | |
| 2012/0288291 | A1 | 11/2012 | Miyadera | |
| 2013/0070040 | A1 | 3/2013 | Miyadera et al. | |
| 2013/0259503 | A1 | 10/2013 | Miyadera et al. | |

FOREIGN PATENT DOCUMENTS

| | | |
|---|---|---|
| JP | 2004-287309 | 10/2004 |
| JP | 2007-241116 | 9/2007 |
| JP | 2008-033168 | 2/2008 |
| JP | 2008-076534 | 4/2008 |
| JP | 2008-139484 | 6/2008 |
| JP | 2011-048350 | 3/2011 |
| JP | 2011-197088 | 10/2011 |

* cited by examiner

FIG.7

| MODE | EVENT | CONTROL OPERATION | NOTE |
|---|---|---|---|
| COLOR PROHIBITION MODE | DETECTION OF END IN ANY OF C-, M-, AND Y-COLOR IMAGE FORMING UNITS | EXECUTE MONOCHROMATIC MODE ONLY | |
| Bk PRIORITY MODE | IF SETTING IS DONE BY USER EXCEPT THE EVENT IN THE FIRST ROW | EXECUTE NORMAL MODE AND MONOCHROMATIC MODE | EMPHASIZE REDUCTION OF COLOR TONER CONSUMPTION WHEN MONOCHROMATIC PRINTING IS PERFORMED MORE OFTEN |
| FC PRIORITY MODE | IF SETTING IS DONE BY USER EXCEPT THE EVENT IN THE FIRST ROW | EXECUTE NORMAL MODE ONLY | EMPHASIZE OPERATION AND QUALITY OF COLOR PRINTING |

FIG.8

| TIMING | JUDGING CRITERION | CONTROL OPERATION | | |
|---|---|---|---|---|
| | | FC PRIORITY MODE | Bk PRIORITY MODE | COLOR PROHIBITION MODE |
| BEFORE START OF JOB (COLOR) | NORMAL MODE = 1 | NORMAL MODE EXECUTION | NORMAL MODE EXECUTION | – |
| | MONOCHROMATIC MODE = 1 | – | – | |
| | OTHERS | – | – | |
| BEFORE START OF JOB (MONOCHROME) | NORMAL MODE = 1 | NORMAL MODE EXECUTION | – | – |
| | MONOCHROMATIC MODE = 1 | – | MONOCHROMATIC MODE EXECUTION | MONOCHROMATIC MODE EXECUTION |
| | OTHERS | – | – | – |

FIG.12

| TIMING | JUDGING CRITERION | CONTROL OPERATION | | |
|---|---|---|---|---|
| | | FC PRIORITY MODE | Bk PRIORITY MODE | COLOR PROHIBITION MODE |
| POWER INPUT (EXCEPT RESTORATION FROM LIGHT DETECTION) | DETECT REST TIME HAS EXCEEDED THRESHOLD VALUE | SP:MUSIC EXECUTION REQUEST NORMAL MODE = 1 | SP:MUSIC EXECUTION REQUEST NORMAL MODE = 1 SP:MUSIC EXECUTION REQUEST MONOCHROMATIC MODE = 1 | SP:MUSIC EXECUTION REQUEST MONOCHROMATIC MODE = 1 |
| RESTORATION FROM LIGHT DETECTION OR SLEEP MODE | DETECT REST TIME HAS EXCEEDED THRESHOLD VALUE | SP:MUSIC EXECUTION REQUEST NORMAL MODE = 1 | SP:MUSIC EXECUTION REQUEST NORMAL MODE = 1 SP:MUSIC EXECUTION REQUEST MONOCHROMATIC MODE = 1 | SP:MUSIC EXECUTION REQUEST MONOCHROMATIC MODE = 1 |
| BEFORE START OF JOB (COLOR) | SP:MUSIC EXECUTION REQUEST NORMAL MODE = 1 | NORMAL MODE EXECUTION | NORMAL MODE EXECUTION | - |
| | SP:MUSIC EXECUTION REQUEST MONOCHROMATIC MODE = 1 | - | - | |
| | OTHERS | - | - | |
| BEFORE START OF JOB (MONOCHROME) | SP:MUSIC EXECUTION REQUEST NORMAL MODE = 1 | NORMAL MODE EXECUTION | - | - |
| | SP:MUSIC EXECUTION REQUEST MONOCHROMATIC MODE = 1 | - | MONOCHROMATIC MODE EXECUTION | MONOCHROMATIC MODE EXECUTION |
| | OTHERS | - | - | - |
| JOB END (COLOR) | SP:MUSIC EXECUTION REQUEST NORMAL MODE = 1 | NOT EXECUTED | NOT EXECUTED | NOT EXECUTED |
| | SP:MUSIC EXECUTION REQUEST MONOCHROMATIC MODE = 1 | NOT EXECUTED | NOT EXECUTED | |
| JOB END (MONOCHROME) | SP:MUSIC EXECUTION REQUEST NORMAL MODE = 1 | NOT EXECUTED | NOT EXECUTED | NOT EXECUTED |
| | SP:MUSIC EXECUTION REQUEST MONOCHROMATIC MODE = 1 | NOT EXECUTED | NOT EXECUTED | NOT EXECUTED |

IMAGE FORMING APPARATUS AND CONVEYANCE CONTROL METHOD

CROSS-REFERENCE TO RELATED APPLICATIONS

The present application claims priority to and incorporates by reference the entire contents of Japanese Patent Application No. 2012-264730 filed in Japan on Dec. 3, 2012, Japanese Patent Application No. 2012-264777 filed in Japan on Dec. 3, 2012 and Japanese Patent Application No. 2012-264778 filed in Japan on Dec. 3, 2012.

BACKGROUND OF THE INVENTION

1. Field of the Invention

The present invention relates to an image forming apparatus and a conveyance control method.

2. Description of the Related Art

In an electrophotography image forming apparatus, an intermediate transfer belt to which an image formed by an image forming unit is transferred is expanded or contracted due to thermal expansion or contraction caused by the change in temperature.

In view of this, in order to form an image at an appropriate position on a recording sheet, it is necessary to perform image position correction for correcting the displacement in image transfer position or conveyance timing correction for correcting the paper conveyance timing in consideration of the expansion or contraction of the intermediate transfer belt.

In the technique disclosed in Japanese Patent Application Laid-open No. 2008-76534, based on the timing at which a first set of the displacement correction pattern is read, the timing of detecting second and subsequent sets of displacement correction patterns is decided. Therefore, even though the intermediate transfer belt is expanded or contracted, it is possible to perform the image position correction by certainly reading the displacement correction patterns of the second and subsequent sets.

Further, if a difference from a reference value of the time of detecting the displacement correction pattern is calculated and the conveyance timing correction is performed based on the calculated difference, the conveyance control of the recording sheet in consideration of the expansion and contraction of the intermediate transfer belt becomes possible.

In the conventional art as described above, the displacement correction pattern formed in color is used; however, from the viewpoint of the accuracy of the paper conveyance timing and the consumption of a developer, the conveyance timing correction using the displacement correction pattern formed in color may not be preferable.

The present invention has been made in view of the above circumstances, and an object is to provide an image forming apparatus and a conveyance control method, that can increase the accuracy of the conveyance control of the recording sheet while the extra consumption of a developer is reduced.

SUMMARY OF THE INVENTION

It is an object of the present invention to at least partially solve the problems in the conventional technology.

According to the present invention, there is provided: an image forming apparatus comprising: a plurality of image forming units configured to form an image in different colors; a conveyance mechanism configured to convey a first pattern formed using at least a first image forming unit among the image forming units, that forms the image in a first color, and convey a second pattern formed using a second image forming unit among the image forming units, that forms the image in a second color; a detection unit configured to detect the first pattern conveyed by the conveyance mechanism and the second pattern conveyed by the conveyance mechanism; and a control unit configured to control, when a first condition is satisfied, a timing of conveying a recording sheet to which the image formed using at least the first image forming unit is transferred on the basis of a first time required after the formation of the first pattern and before the detection of the first pattern by the detection unit, and the control unit configured to control, when a second condition is satisfied, a timing of conveying the recording sheet to which the image formed using the second image forming unit is transferred on the basis of a second time required after the formation of the second pattern and before the detection of the second pattern by the detection unit.

The present invention also provides an image forming apparatus comprising: a plurality of image forming units configured to form an image in different colors; a conveyance mechanism configured to convey a first pattern formed using at least a first image forming unit among the image forming units, that forms the image in a first color, and convey a second pattern formed using a second image forming unit among the image forming units, that forms the image in a second color; a detection unit configured to detect the first pattern conveyed by the conveyance mechanism and the second pattern conveyed by the conveyance mechanism; a storage unit configured to store a first temperature at the detection of the first pattern and a second temperature at the detection of the second pattern; and a control unit configured to control, when the first pattern has been previously detected, a timing of conveying a recording sheet to which the image formed using at least the first image forming unit is transferred on the basis of a first time required after the formation of the first pattern and before the detection of the first pattern by the detection unit, the first temperature, and a current temperature, and the control unit configured to control, when the second pattern has been previously detected, a timing of conveying the recording sheet to which the image formed using the second image forming unit is transferred on the basis of a second time required after the formation of the second pattern and before the detection of the second pattern by the detection unit, the second temperature, and the current temperature.

The present invention also provides an image forming apparatus comprising: a plurality of image forming units configured to form an image in different colors; a conveyance mechanism configured to convey a first pattern formed using at least a first image forming unit among the image forming units, that forms the image in a first color, and convey a second pattern formed using a second image forming unit among the image forming units, that forms the image in a second color; a detection unit configured to detect the first pattern conveyed by the conveyance mechanism and detecting the second pattern conveyed by the conveyance mechanism; a storage unit configured to store therein position adjustment information representing for which one of the first image and the second image position adjustment on a recording sheet has been performed, a first reference value as a reference value of a first time required after the image formation of the first pattern and before the detection of the first pattern by the detection unit, and a second reference value as a reference value of a second time required after the image formation of the second pattern and before the detection of the second pattern by the detection unit; and a control unit configured to control, when the position adjustment information represents that the position adjustment for the first image on the recording sheet has been performed, a timing of conveying the recording sheet to which the image formed by the first image forming unit is transferred on the basis of the first time and the first reference value and controlling a timing of conveying the recording sheet to which the image formed by the second image forming unit is transferred on the basis of the second time, the first reference value, and the second reference value, and the control unit configured to control, when the position adjustment information represents that the position adjustment for the second image on the recording sheet has been performed, a timing of conveying the recording sheet to which the image formed by the first image forming unit is transferred on the basis of the first time, the first reference value, and the second reference value and controlling a timing of conveying the recording sheet to which the image formed by the second image forming unit is transferred on the basis of the second time and the second reference value.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 7 is an explanatory view of the FC priority mode, the Bk priority mode, and the color prohibition mode in the first embodiment;

FIG. 8 is an explanatory view of a timing of executing of the detection of the displacement correction pattern according to the first embodiment;

FIG. 12 is an explanatory view of a timing of executing of the detection of the displacement correction pattern according to a second embodiment;

DETAILED DESCRIPTION OF THE PREFERRED EMBODIMENTS

First Embodiment

An embodiment of an image forming apparatus and a conveyance control method according to the present invention is hereinafter described in detail with reference to the attached drawings. Although an example of applying the image forming apparatus of the present invention to an electrophotography color printer is described in the embodiment below, the present invention is not limited thereto. The image forming apparatus of the present invention can be applied to any apparatus that forms a color image in electrophotography; for example, the present invention is applicable to an electrophotography copier or a multifunctional peripheral (MFP). Note that the multifunctional peripheral refers to an apparatus having at least two functions of a printing function, a copying function, a scanner function, and a facsimile function.

Figure 1:
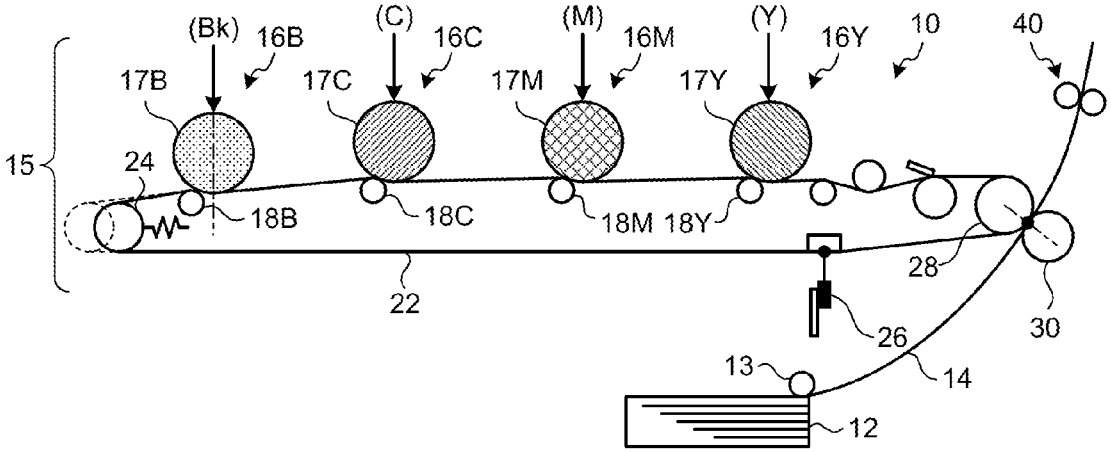
FIG. 1 is a schematic diagram illustrating an example of an entire structure of a printer according to a first embodiment.
Figure 2:
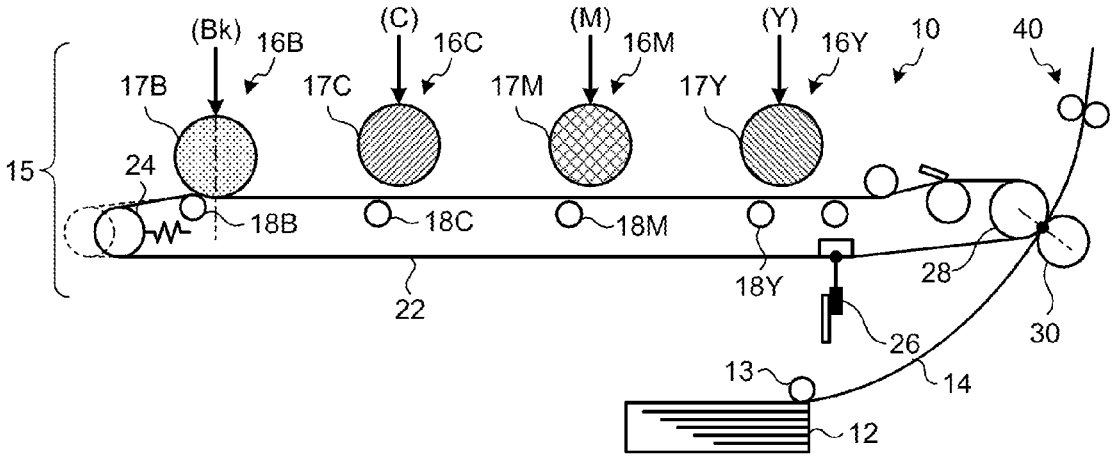
FIG. 2 is a schematic diagram illustrating an example of an entire structure of a printer according to the first embodiment.

FIG. 1 and FIG. 2 are schematic diagrams illustrating an example of the entire structure of a printer 10 of this embodiment; FIG. 1 illustrates a state in which color printing (image formation) is performed while FIG. 2 illustrates a state in which monochromatic printing (image formation) is performed. As shown in FIG. 1 and FIG. 2, the printer 10 includes a paper feeding tray 12, a paper feeding roller 13, a paper conveyance belt 14, an image forming unit 15, and a fixing unit 40. Although FIG. 1 illustrates a so-called tandem printer in which image forming units of different colors are arranged along a conveyance belt as described later, the present invention is not limited thereto.

The paper feeding tray 12 has a plurality of recording sheets stacked therein.

The paper feeding roller 13 is in contact with the uppermost recording sheet of the recording sheets stacked in the paper feeding tray 12, and feeds the uppermost recording sheet therefrom.

The recording sheet fed from the paper feeding roller 13 is sucked on the paper conveyance belt 14 by an electrostatic adsorption action, and the sucked recording sheet is conveyed to the image forming unit 15 (specifically, to the secondary transfer position).

The image forming unit 15 is to form an image on the recording sheet conveyed by the paper conveyance belt 14, and includes image forming units 16B, 16C, 16M, and 16Y, an intermediate transfer belt 22, a tension roller 24, a toner marking sensor (hereinafter referred to as a TM sensor) 26, a driving roller 28, and a secondary transfer roller 30.

The image forming units 16B, 16C, 16M, and 16Y are arranged along the intermediate transfer belt 22 in the order of the image forming units 16Y, 16M, 16C, and 16B from the upstream side of the conveyance direction of the intermediate transfer belt 22.

The image forming unit 16B includes a photosensitive drum 17B, a charging device (not illustrated), a developing device (not illustrated), a transferring device 18B, a photosensitive cleaner (not illustrated), and a neutralizing device (not illustrated), which are disposed around the photosensitive drum 17B.

Note that each of the image forming units 16C, 16M, and 16Y has components common to the image forming unit 16B. In the example of FIG. 1 and FIG. 2, the components of the image forming units 16C, 16M, and 16Y are denoted by C, M, and Y, respectively instead of B of the components for the image forming unit 16B.

In this embodiment, in the case of forming a color image, the photosensitive drums 17B, 17C, 17M, and 17Y are brought into contact with the intermediate transfer belt 22 as shown in FIG. 1; in the case of forming a monochromatic image, the photosensitive drum 17B is brought into contact with the intermediate transfer belt 22 and the photosensitive drums 17C, 17M, and 17Y are lifted up from the intermediate transfer belt 22 as shown in FIG. 2.

The image forming unit 16B and a LEDA (Light Emitting Diode Array) head (not illustrated) perform the image formation process (charging step, exposing step, developing step, transferring step, cleaning step, and neutralizing step) in a state that the photosensitive drum 17B is in contact with the intermediate transfer belt 22; thus, a black toner image is formed on the intermediate transfer belt 22.

Similarly, the image forming unit 16C and a LEDA head perform the image formation process in a state that the photosensitive drum 17C is in contact with the intermediate transfer belt 22; thus, a cyan toner image is formed on the intermediate transfer belt 22. The image forming unit 16M and a LEDA head perform the image formation process in a state that the photosensitive drum 17M is in contact with the intermediate transfer belt 22; thus, a magenta toner image is formed on the intermediate transfer belt 22. The image forming unit 16Y and a LEDA head perform the image formation process in a state that the photosensitive drum 17Y is in contact with the intermediate transfer belt 22; thus, a yellow toner image is formed on the intermediate transfer belt 22.

In other words, in this embodiment, in the case of forming the color image, the image forming units 16B, 16C, 16M, and 16Y perform the image forming process; on the other hand, in the case of forming the monochromatic image, the image forming unit 16B performs the image forming process but the image forming units 16C, 16M, and 16Y do not perform the image forming process.

The description is hereinafter made of the image forming process of the image forming unit 16B mainly, and the description of the image forming process of the image forming units 16C, 16M, and 16Y is omitted.

The photosensitive drum 17B is rotated and driven by a driving motor, which is not illustrated.

First, in the charging step, the outer peripheral surface of the photosensitive drum 17B driven and rotated is uniformly charged by the charging device in darkness.

Then, in the exposing step, the outer peripheral surface of the photosensitive drum 17B driven and rotated is irradiated with irradiation light (Bk) corresponding to the black image from the LEDA head, thereby forming an electrostatic latent image based on the black image on the photosensitive drum 17B.

Subsequently, in the developing step, the developing device develops the electrostatic latent image formed on the photosensitive drum 17B with black toner, thereby forming a black toner image on the photosensitive drum 17B.

Then, in the transferring step, the transferring device 18B transfers the black toner image formed on the photosensitive drum 17B to the intermediate transfer belt 22 at a primary transfer position where the transferring device 18B is in contact with the photosensitive drum 17B. Note that a slight amount of untransferred toner remains on the photosensitive drum 17B after the transfer of the toner image.

Subsequently, in the cleaning step, the photosensitive cleaner removes the untransferred toner remaining on the photosensitive drum 17B.

Finally, in the neutralizing step, the neutralizing device neutralizes the remaining potential on the photosensitive drum 17B. Then, the image forming unit 16B stands-by for the next image formation.

The intermediate transfer belt 22 (an example of the conveyance mechanism) is an endless belt wound around the tension roller 24 and the driving roller 28, and the belt is moved endlessly in the order of the image forming units 16Y, 16M, 16C, and 16B when the driving roller 28 is driven and rotated by the driving motor, which is not illustrated.

As shown in FIG. 1, in the case of forming the color image, first, the yellow toner image is transferred to the intermediate transfer belt 22 by the image forming unit 16Y, and then, the magenta toner image, the cyan toner image, and the black toner image are transferred in the overlapped state by the image forming units 16M, 16C, and 16B, respectively. Thus, the full-color image is formed on the intermediate transfer belt 22.

As shown in FIG. 2, in the case of forming the monochromatic image, the black toner image is transferred to the intermediate transfer belt 22 by the image forming unit 16B. Thus, the monochromatic image is formed on the intermediate transfer belt 22.

As soon as the image formed on the intermediate transfer belt 22 reaches a secondary transfer position where the secondary transfer roller 30 is in contact with the driving roller 28, the recording sheet conveyed by the paper conveyance belt 14 is pressed against the image formed on the intermediate transfer belt 22 at the secondary transfer position. Thus, the image is transferred to the recording sheet from the intermediate transfer belt 22.

The fixing unit 40 fixes the image transferred to the recording sheet by heating and pressing the recording sheet conveyed by the paper conveyance belt 14. The recording sheet having the image fixed thereon is discharged out of the printer 10.

The tension roller 24 absorbs the entire expansion of the intermediate transfer belt 22 caused by the temperature change by applying tension to the intermediate transfer belt 22. In other words, in this embodiment, the intermediate transfer belt 22 is not expanded uniformly but the expansion of the intermediate transfer belt 22 due to the temperature change is collected to the tension roller 24.

In this embodiment, the tension roller 24 is positioned in a route of the intermediate transfer belt 22 from the primary transfer position on the most downstream side (the primary transfer position where the photosensitive drum 17B is in contact with the transferring device 18B) to the TM sensor 26.

Therefore, in this embodiment, if the influence of the temperature change is equal, the amount of expansion of the intermediate transfer belt 22 in the image conveyance distance of the intermediate transfer belt 22 in the case of forming the color image (distance from the first primary transfer position where the photosensitive drum 17B is in contact with the transferring device 18B to the secondary transfer position) becomes equal to the amount of expansion of the intermediate transfer belt 22 in the image conveyance distance of the intermediate transfer belt 22 in the case of forming the monochromatic image (distance from the first primary transfer position where the photosensitive drum 17B is in contact with the transferring device 18B to the secondary transfer position).

The TM sensor 26 (an example of detector) is, for example, a photosensor, and reads a displacement correction pattern formed on the intermediate transfer belt 22. In this embodiment, in the case of forming the color image as shown in FIG. 1, the displacement correction pattern (an example of a first pattern) is formed in four colors on the intermediate transfer belt 22 by the image forming units 16B, 16C, 16M, and 16Y; in the case of forming the monochromatic image as shown in FIG. 2, the displacement correction pattern (an example of a second pattern) is formed in monochrome on the intermediate transfer belt 22 by the image forming unit 16B.

Figure 3:
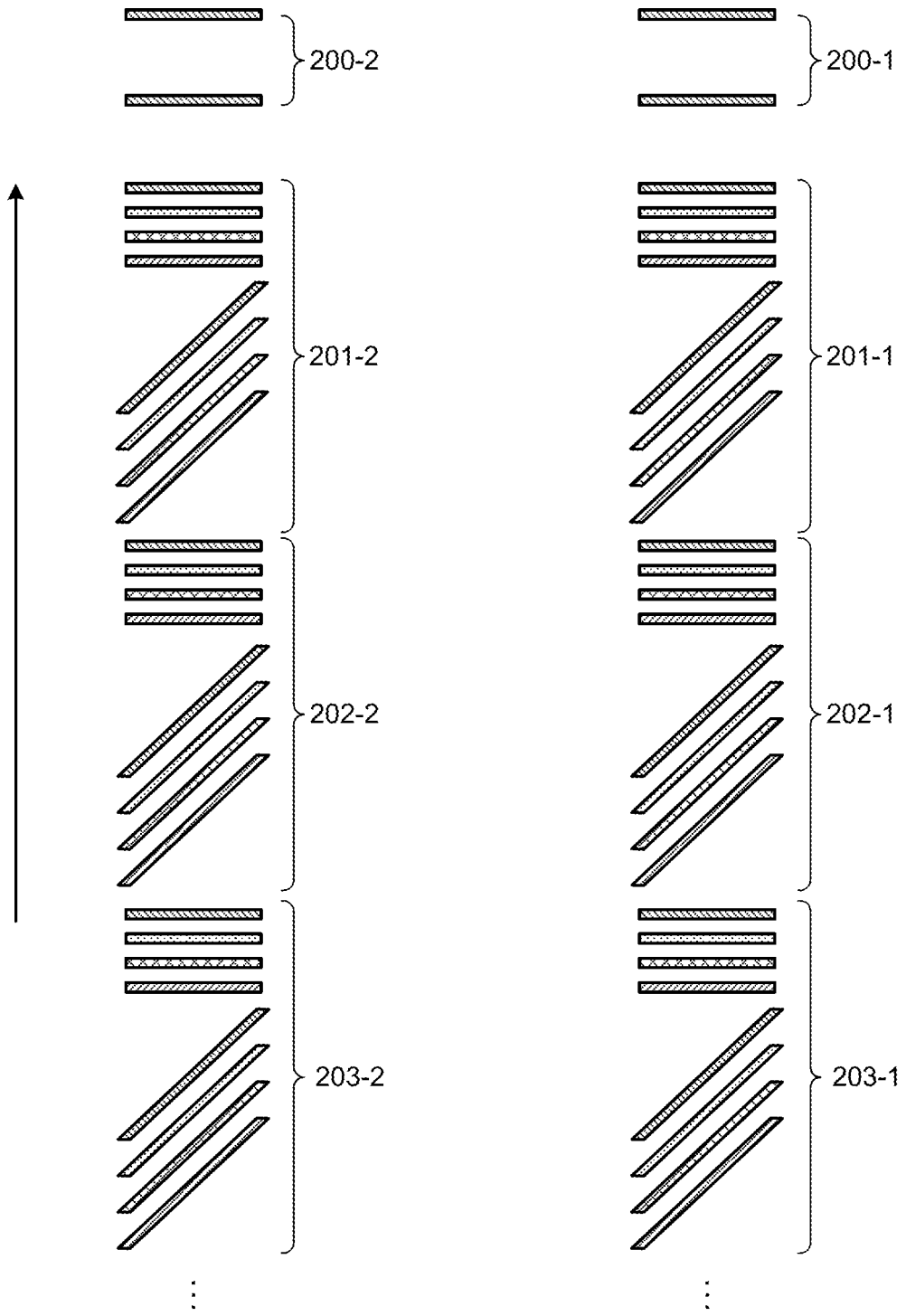
FIG. 3 is a diagram illustrating an example of a displacement correction pattern formed in color according to the first embodiment.

FIG. 3 illustrates an example of the displacement correction pattern formed in color of this embodiment. As shown in FIG. 3, the displacement correction pattern formed in color includes detection timing correction patterns 200-1 and 200-2 at the head, which are followed by correction pattern rows 201-1 to 203-1 and 201-2 to 203-2, respectively.

The detection timing correction patterns 200-1 and 200-2 are each formed of two Y-color linear patterns. The correction pattern rows 201-1 to 203-1 and 201-2 to 203-2 are each formed of eight pattern rows in total: four linear patterns and four oblique patterns. The four linear patterns and the four oblique patterns are each formed of four colors of Y, B, M, and C.

In the example of FIG. 3, the number of correction pattern rows disposed in a sub-scanning direction (the number of correction pattern rows disposed after the detection timing correction pattern) is three; however, the present invention is not limited thereto and may be any number. In the example of FIG. 3, similarly, the two pattern rows each including the detection timing correction pattern and the correction pattern rows are provided in parallel; however, the present invention is not limited thereto and the number of rows may be determined in accordance with the number of TM sensors 26.

By detecting the detection timing correction patterns 200-1 and 200-2 with the TM sensor 26, the time after the image forming unit 16Y forms (specifically, exposes) the detection timing correction patterns 200-1 and 200-2 and before the formed patterns reaches the detection position of the TM sensor 26 is detected.

Then, the difference between the detected time and a reference value (logical value) is calculated, and based on the calculated difference, the timing of reading out the correction pattern rows 201-1 to 203-1 and 201-2 to 203-2 with the TM sensor 26 is corrected, whereby the TM sensor 26 can surely detect the correction pattern rows 201-1 to 203-1 and 201-2 to 203-2. Since the detection results reflect the displacement amount due to the tolerance of the incidence angle of the LEDA light on the photosensitive drum or the displacement amount due to the change in conveyance speed of the intermediate transfer belt, the image position correction can be performed. By using the calculated difference, similarly, the timing of conveying the recording sheet to the secondary transfer position by the paper conveyance belt 14 can be corrected.

In the example of FIG. 3, the detection timing correction patterns 200-1 and 200-2 are formed in Y color because, in the case of the color image formation, the image forming unit 16Y is in the most upstream side of the image forming process and the amount of delay is 0. As a result, the influence of the measurement error from hardware after the image formation of the detection timing correction patterns 200-1 and 200-2 by the image forming unit 16Y to the detection of the patterns by the TM sensor 26 can be reduced, thereby increasing the accuracy of the image position correction or the conveyance timing correction.

Figure 4:
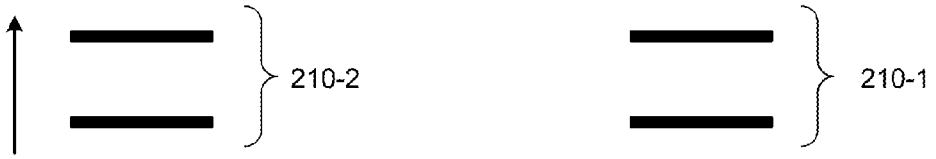
FIG. 4 is a diagram illustrating an example of a displacement correction pattern formed in monochrome according to the first embodiment.

FIG. 4 is a diagram illustrating an example of the displacement correction pattern formed in monochrome of this embodiment. As shown in FIG. 4, the displacement correction pattern formed in monochrome includes detection timing correction patterns 210-1 and 210-2 at the head.

Each of the detection timing correction patterns 210-1 and 210-2 includes two linear patterns of the B color. In the example of FIG. 4, the two pattern rows including the detection timing correction patterns are provided in parallel; however, the present invention is not limited thereto and the number of the pattern rows may be determined in accordance with the number of TM sensors 26.

The TM sensor 26 detects the detection timing correction patterns 210-1 and 210-2. Since the detection results reflect the displacement due to the tolerance of the incidence angle of the LEDA light on the photosensitive drum or the displacement due to the change in conveyance speed of the intermediate transfer belt, the image position correction can be performed.

By detecting the detection timing correction patterns 210-1 and 210-2 with the TM sensor 26, the time after the image forming unit 16Y forms (specifically, exposes) the detection timing correction patterns 210-1 and 210-2 and before the formed patterns reaches the detection position of the TM sensor 26 is detected. Then, the difference between the detected time and a reference value (logical value) is calculated, and based on the calculated difference, the timing of conveying the recording sheet to the secondary transfer position by the paper conveyance belt 14 can be corrected.

In the example of FIG. 4, the detection timing correction patterns 210-1 and 210-2 are formed in the B color because, in the case of the monochromatic image formation, the image forming unit 16B is in the most upstream side of the image forming process and the amount of delay is 0. As a result, the influence of the measurement error from hardware after the image formation of the detection timing correction patterns 210-1 and 210-2 by the image forming unit 16B to the detection of the patterns by the TM sensor 26 can be reduced, thereby the accuracy of the image position correction or the conveyance timing correction is increased.

Figure 5:
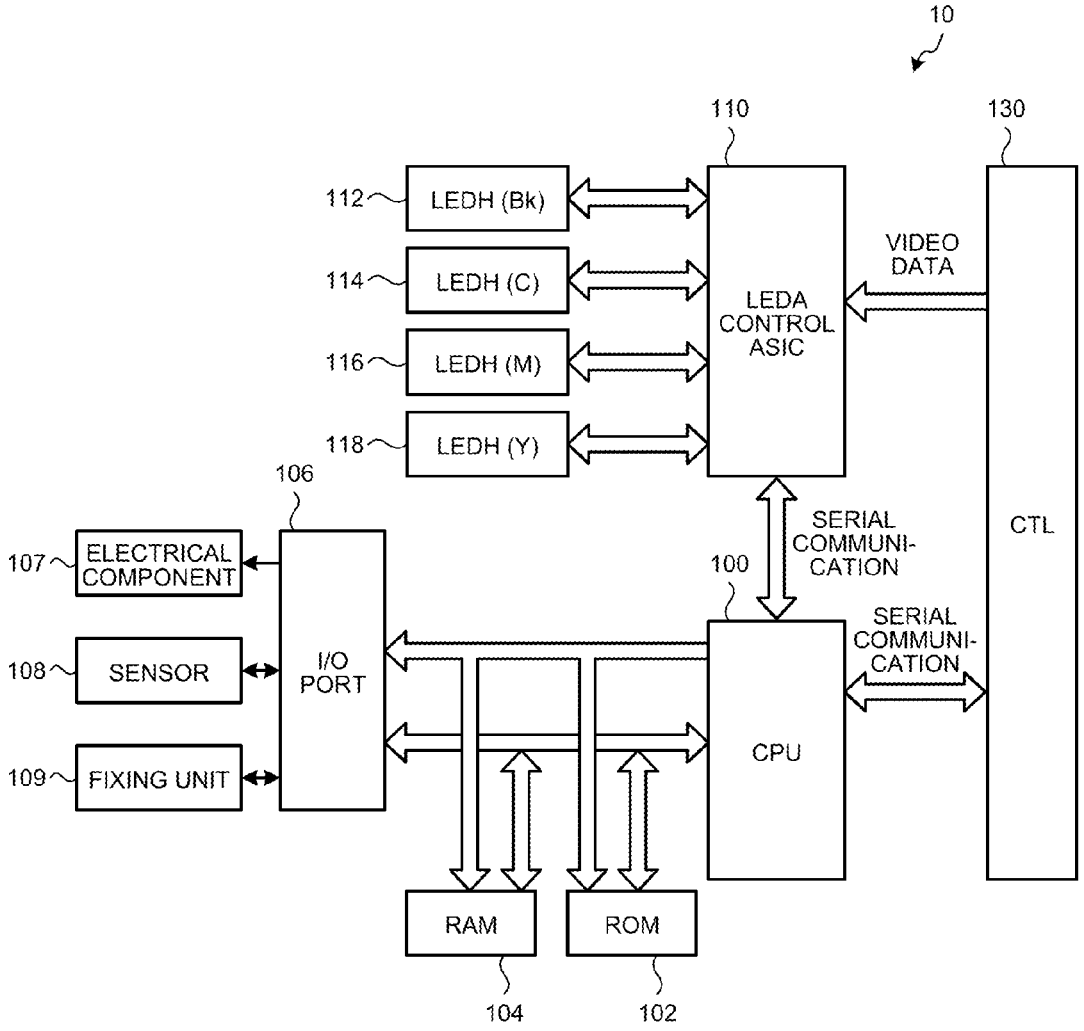
FIG. 5 is a diagram illustrating an example of a hardware structure of the printer according to the first embodiment.

FIG. 5 is a diagram illustrating an example of a hardware structure of the printer 10 of this embodiment. As shown in FIG. 5, the printer 10 includes: a CPU (Central Processing Unit) 100; ROM (Read Only Memory) 102; RAM (Random Access Memory) 104; an I/O port 106; an electrical component 107; a sensor 108; a fixing unit 109; a LEDA control ASIC (Application Specific integrated Circuit) 110; a LEDH (Bk) 112; a LEDH(C) 114; a LEDH(M) 116; a LEDH(Y) 118; and a CTL 130.

The CTL 130 is a controller for controlling the printer 10, and upon the reception of a print job from a host computer or the like, the CTL 130 transmits video data such as the image data included in the print job to the LEDA control ASIC 110, performs serial communication with the CPU 100, and orders the print control.

Upon the reception of the video data from the CTL 130, the LEDA control ASIC 110 converts the received video data into signals for causing the LEDH(Bk) 112, the LEDH(C) 114, the LEDH(M) 116, and the LEDH(Y) 118 to emit light. By making the LEDH(Bk) 112, the LEDH(C) 114, the LEDH (M) 116, and the LEDH(Y) 118 emit light (illuminate) on the basis of the converted signals, the image data are written.

In conjunction with the writing of the image data by the LEDH(Bk) 112, the LEDH(C) 114, the LEDH(M) 116, and the LEDH(Y) 118, the image forming units 16B, 16C, 16M, and 16Y execute the image forming process by electrophotography and transfer the formed toner image to the sheet.

If the video data are the video data for the color image, the LEDA control ASIC 110 causes the LEDH(Bk) 112, the LEDH(C) 114, the LEDH(M) 116, and the LEDH(Y) 118 to emit light (illuminate); however, if the video data are the video data for the monochromatic image, the LEDA control ASIC 110 causes only the LEDH(Bk) 112 to emit light (illuminate).

The CPU 100 uses the RAM 104 as a working area where the CPU 100 executes the program stored in the ROM 102 as flash ROM, thereby performing various controls over the printer 10. For example, upon the reception of the order of the print control from the CTL 130, the CPU 100 performs the serial communication with the LEDA control ASIC 110 to control the light emission timing of the LEDH(Bk) 112, the LEDH(C) 114, the LEDH(M) 116, and the LEDH(Y) 118 or to control the electrical component 107, the sensor 108 such as the TM sensor 26 or a temperature and humidity sensor (not illustrated), and the fixing unit 109 such as the fixing unit 40 via the I/O port 106.

The CPU 100 performs the image position correction or the conveyance timing correction. The description is hereinafter made of the image position correction or the conveyance timing correction by the CPU 100.

First, the image position correction is described with reference to FIG. 6.

Figure 6:
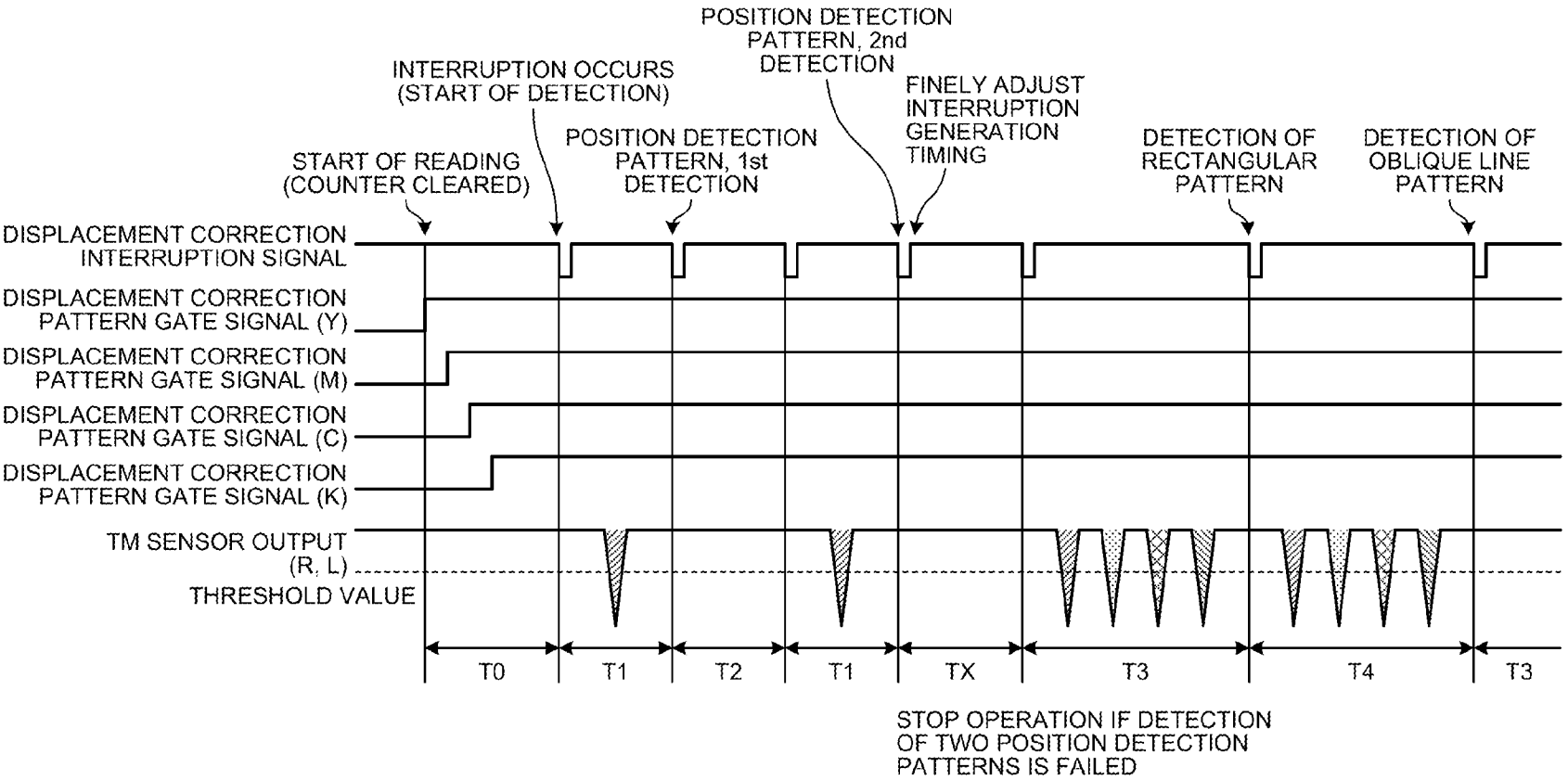
FIG. 6 is a diagram illustrating an example of a timing of detecting the displacement correction pattern formed in color according to the first embodiment.

FIG. 6 is a diagram depicting an example of the timing of detecting the displacement correction pattern formed in color according to this embodiment.

First, at the same time as the start of the image formation of the detection timing correction pattern 200-1 (gate signal assert), the pattern detection counter is reset.

Subsequently, the CPU 100 sets the interruption signal generation timing T0 (several milliseconds before the detection of the detection timing correction pattern 200-1), and when the time has reached T0, the interruption signal is generated and the pattern detection counter is reset at the same time again. Then, the CPU 100 sets the next interruption signal generation timing T1.

Next, since the TM sensor 26 detects the detection timing correction pattern 200-1 before T1, the output signal intersects with the threshold value on this timing and the counter value in the pattern detection counter is saved in a timing storage register.

Subsequently, when the time has reached T1, the interruption signal is generated; therefore, the CPU 100 reads out the counter value from the timing storage register. From this counter value, the time after the start of the image formation of the detection timing correction pattern 200-1 and before the detection of the first linear pattern of the detection timing correction pattern 200-1 by the TM sensor 26 can be specified.

Then, the CPU 100 sets the interruption signal generation timing T2, and repeats the process from the setting of T0 to the acquisition of the counter value once again; thus, the counter value is acquired. From this counter value, the time after the start of the image formation of the detection timing correction pattern 200-1 and before the detection of the second linear pattern of the detection timing correction pattern 200-1 by the TM sensor 26 can be specified.

The CPU 100 compares a reference value (an example of a first reference value) for the displacement correction pattern formed in color with the time after the start of the image formation of the detection timing correction pattern 200-1 and before the detection of at least one of the first linear pattern and the second linear pattern of the detection timing correction pattern 200-1 by the TM sensor 26, and calculates the correction amount (difference). The reference value for the displacement correction pattern formed in color is, for example, measured in advance and stored in the ROM 102.

Thus, the CPU 100 can know the displacement of the timing of detecting the displacement correction pattern formed in color; therefore, the next interruption signal generation timing TX is calculated and set based on this correction amount. As a result, the CPU 100 can generate the interruption signal at the timing suitable for acquiring the detection results of the correction pattern rows 201-1 to 203-1.

Next, when the time has reached the timing TX, the interruption signal is generated; therefore, the CPU 100 sets the interruption signal generation timing T3 for the linear pattern of the correction pattern row 201-1 and the interruption signal generation timing T4 for the oblique pattern of the correction pattern row 201-1 in this order. Thus, the CPU 100 can acquire the detection results of the linear pattern or the oblique pattern of the correction pattern row 201-1 at the optimal timing. This similarly applies to the correction pattern rows 202-1 and 203-1.

Then, in accordance with the detection results of the correction pattern rows 201-1 to 203-1, the CPU 100 causes the LEDA control ASIC 110 to correct the light emission timings of the LEDH(Bk) 112, the LEDH(C) 114, the LEDH(M) 116, and the LEDH(Y) 118, thereby the CPU 100 performs the image position correction.

The above description made of the detection timing correction pattern 200-1 and the correction pattern rows 201-1 to 203-1 similarly applies to the detection timing correction pattern 200-2 and the correction pattern rows 201-2 to 203-2.

In the case of the displacement correction pattern formed in monochrome, the CPU 100 performs the detection of the detection timing correction patterns 210-1 and 210-2 in a manner similar to the detection of the detection timing correction patterns 200-1 and 200-2, and using the detection results of the detection timing correction patterns 210-1 and 210-2, the CPU 100 performs the image position correction.

Next, the conveyance timing correction is described. Note that in the description below, the correction amount is calculated on the premise that the following conditions (1) to (6) are satisfied:

(1) the number of rotations of the photosensitive drum does not change even though the environment changes or the time has passed;

(2) the amount of change in distance from the primary transfer position to the secondary transfer position due to the expansion of the intermediate transfer belt is the same in the case of forming either the color image or the monochromatic image;

(3) the number of rotations of the photosensitive drum does not change in the case of forming either the color image or the monochromatic image;

(4) the linear velocity of the intermediate transfer belt does not change in the case of forming either the color image or the monochromatic image;

(5) the opening or closing of the cover does not change the position of the LEDA exposure; and (6) the exchange of PCDU does not change the primary transfer position.

In the description below, "the detection of the displacement correction pattern formed in color" may be referred to as "the detection of the displacement correction pattern in the normal mode", "the reference value for the displacement correction pattern formed in color" may be referred to as "the reference value for the normal mode", "the detection timing correction pattern 200-1" may be referred to as "the detection timing correction pattern (Y)R", and "the detection timing correction pattern 200-2" may be referred to as "the detection timing correction pattern (Y)L".

Similarly, in the description below, "the detection of the displacement correction pattern formed in monochrome" may be referred to as "the detection of the displacement correction pattern in the monochromatic mode", "the reference value for the displacement correction pattern formed in monochrome" may be referred to as "the reference value for the monochromatic mode", "the detection timing correction pattern 210-1" may be referred to as "the detection timing correction pattern (B)R", and "the detection timing correction pattern 210-2" may be referred to as "the detection timing correction pattern (B)L".

In the case of the detection of the displacement correction pattern in the normal mode, the CPU 100 calculates the correction amount for the normal mode using Formula (1).

Correction amount for the normal mode={(measurement value of detection timing correction pattern (Y)R+measurement value of detection timing correction pattern (Y)L)/2−reference value for the normal mode}×sampling length $d1$[μm] (1)

In the case of the detection of the displacement correction pattern in the monochromatic mode, the CPU 100 calculates the correction amount for the normal mode using Formula (2).

Correction amount for the normal mode={(measurement value of detection timing correction pattern (B)R+measurement value of detection timing correction pattern (B)L)/2−reference value for the monochromatic mode}×sampling length $d1$ [μm] (2)

In a manner similar to the reference value for the normal mode, the reference value for the monochromatic mode is also measured and stored in the ROM 102 in advance. The correction amount for the normal mode and the correction amount for the monochromatic mode consist of significant five digits (−32768 to 32767); however, the present invention is not limited thereto.

When the first condition is satisfied, the CPU 100 controls the conveyance timing for the recording sheet to which the color image is transferred, by using the correction amount for the normal mode; when the second condition is satisfied, the CPU 100 controls the conveyance timing for the recording sheet to which the monochromatic image is transferred, by using the correction amount for the monochromatic mode.

Specifically, if the first condition is satisfied, the CPU 100 determines the position correction amount ΔP [μm] from the correction amount for the normal mode, and based on the position correction amount ΔP [μm], the CPU 100 corrects and controls the timing of feeding paper from the paper feeding roller 13 or the timing of conveying the recording sheet with the paper conveyance belt 14. Similarly, if the second condition is satisfied, the CPU 100 determines the position correction amount ΔP [μm] from the correction amount for the monochromatic mode, and based on the position correction amount ΔP [μm], the CPU 100 corrects and controls the timing of feeding paper from the paper feeding roller 13 or the timing of conveying the recording sheet with the paper conveyance belt 14.

If the mode of the printer 10 is the FC priority mode for putting priority on the color image formation, the first condition is satisfied. Moreover, if the mode of the printer 10 is the Bk priority mode for putting priority on the monochromatic image formation or is the color prohibition mode for prohibiting the color image formation, the first condition is satisfied as long as the previous detection of the displacement correction pattern is the detection of the displacement correction pattern in the normal mode. On the other hand, if the mode of the printer 10 is the Bk priority mode for putting priority on the monochromatic image formation or is the color prohibition mode for prohibiting the color image formation, the second condition is satisfied as long as the previous detection of the displacement correction pattern is the detection of the displacement correction pattern in the monochromatic mode.

Whether the previous detection of the displacement correction pattern is the detection of the displacement correction pattern in the normal mode or the detection of the displacement correction pattern in the monochromatic mode is stored as the information in the ROM 102 every time when the CPU 100 detects the displacement correction pattern, and this information may be referred to.

FIG. 7 is an explanatory view of the FC priority mode, the Bk priority mode, and the color prohibition mode of this embodiment. As shown in FIG. 7, the FC priority mode and the Bk priority mode are the modes set by the CPU 100 when the setting is ordered by a user through an operation panel or the like, which is not illustrated. The color prohibition mode is the mode set by the CPU 100 upon the detection of the toner end of any of the cyan toner, the yellow toner, and the magenta toner.

The FC priority mode is the mode in which the operation and quality of the color printing are considered important, and is executed only in the normal mode (image formation in color). The Bk priority mode is the mode in which the reduction of the consumption of the color toner (cyan toner, yellow toner, and magenta toner) is considered important when the monochromatic printing is performed more often, and is executed not just in the monochromatic mode (image formation in monochrome) but also in the normal mode (image formation in color). The color prohibition mode is the mode in which the color printing is prohibited, and is executed only in the monochromatic mode (image formation in monochrome).

Next, the timing of executing the detection of the displacement correction pattern is described. FIG. 8 is an explanatory view of the timing of executing the detection of the displacement correction pattern according to this embodiment. In this embodiment, basically, the detection of the displacement correction pattern is executed before the start of the job; however, the timing of the execution is not limited thereto.

It is assumed that the detection of the displacement correction pattern in the normal mode is requested before the start of the job for the color. In this case, if the mode is the FC priority mode or the Bk priority mode, the CPU 100 executes the detection of the displacement correction pattern in the normal mode before the start of the job for the color.

It is assumed that the detection of the displacement correction pattern in the normal mode is requested before the start of the job for the monochrome. In this case, if the mode is the FC priority mode, the CPU 100 executes the detection of the displacement correction pattern in the normal mode before the start of the job for the monochrome.

It is assumed that the detection of the displacement correction pattern in the monochromatic mode is requested before the start of the job for the monochrome. In this case, if the mode is the Bk priority mode or the color prohibition mode, the CPU 100 executes the detection of the displacement correction pattern in the monochromatic mode before the start of the job for the monochrome.

Figure 9:
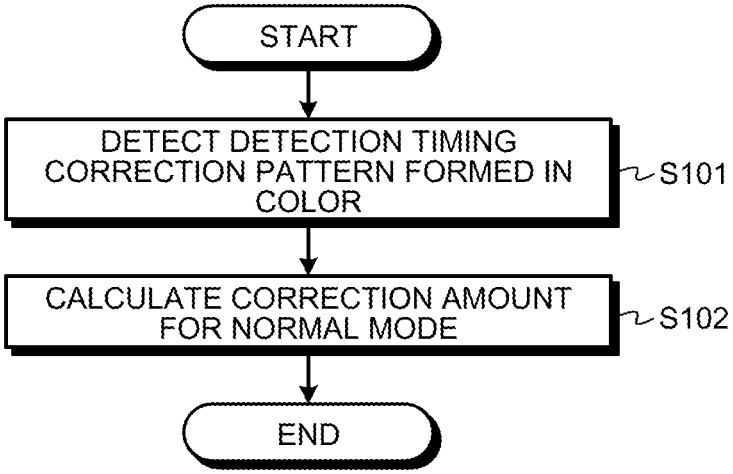
FIG. 9 is a flowchart of an example of a process of calculating the correction amount for the normal mode in the first embodiment.

FIG. 9 is a flowchart of an example of a process of calculating the correction amount for the normal mode in this embodiment.

First, upon the execution of the detection of the displacement correction pattern in the normal mode, the displacement correction pattern are formed in four colors on the intermediate transfer belt 22 by the image forming units 16B, 16C, 16M, and 16Y, and the detection timing correction patterns 200-1 and 200-2 of the displacement correction pattern are detected by the TM sensor 26 (Step S101).

Subsequently, the CPU 100 acquires the counter value for specifying the time after the start of the image formation of the detection timing correction patterns 200-1 and 200-2 and before the detection thereof by the TM sensor 26, and a reference value for the normal mode. Using Formula (1), the CPU 100 calculates the correction amount for the normal mode and stores the calculated amount in the ROM 102 (Step S102).

Figure 10:
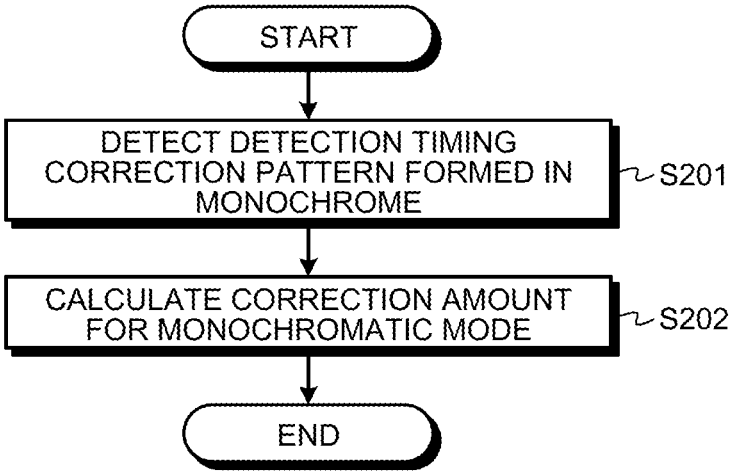
FIG. 10 is a flowchart of an example of a process of calculating the correction amount for the monochromatic mode in the first embodiment.

FIG. 10 is a flowchart of an example of a process of calculating the correction amount for the monochromatic mode according to this embodiment.

First, upon the execution of the detection of the displacement correction pattern in the monochromatic mode, the displacement correction pattern formed in monochrome is formed on the intermediate transfer belt 22 by the image forming unit 16B, and the detection timing correction patterns 210-1 and 210-2 of the displacement correction pattern are detected by the TM sensor 26 (Step S201).

Subsequently, the CPU 100 acquires the counter value for specifying the time after the start of the image formation of the detection timing correction patterns 210-1 and 210-2 and before the detection thereof by the TM sensor 26, and a reference value for the monochromatic mode. Using Formula (2), the CPU 100 calculates the correction amount for the monochromatic mode and stores the calculated amount in the ROM 102 (Step S202).

Figure 11:
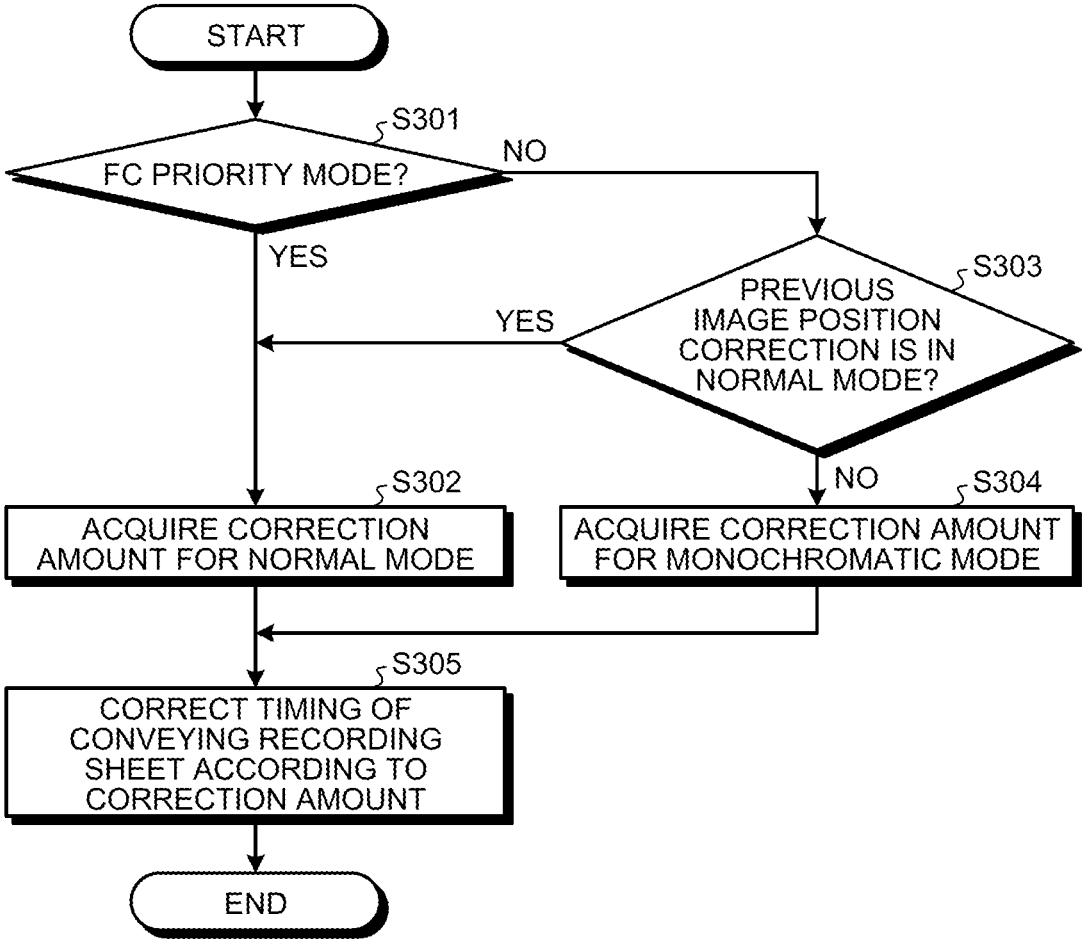
FIG. 11 is a flowchart of an example of a process of correcting the conveyance timing in the first embodiment.

FIG. 11 is a flowchart of an example of a process of correcting the conveyance timing according to this embodiment.

First, the CPU 100 checks whether the mode of the printer 10 is the FC priority mode or not before the start of the printing (Step S301), and when the mode is the FC priority mode (Yes in Step S301), the CPU 100 acquires the correction amount for the normal mode from the ROM 102 (Step S302).

When the mode is not the FC priority mode (No in Step S301), the mode is the Bk priority mode or the color prohibition mode; therefore, the CPU 100 checks whether or not the previous detection of the displacement correction pattern (image position correction) has been performed in the normal mode (Step S303).

When the mode is the normal mode (Yes in Step 3303), the CPU 100 acquires the correction amount for the normal mode from the ROM 102 (Step S302); when the mode is not the normal mode but the monochromatic mode (No in Step S303), the CPU 100 acquires the correction amount for the monochromatic mode from the ROM 102 (Step S304).

Subsequently, the CPU 100 determines the position correction amount calculated from the acquired correction amount, and using the position correction amount, the CPU 100 corrects and controls the timing of feeding paper from the paper feeding roller 13 or the timing of conveying the recording sheet by the paper conveyance belt 14 (Step S305).

As described above, in this embodiment, the detection of the displacement correction pattern is performed using not just the color but also the monochrome; by using the detection results (detection time) obtained from the monochrome, the conveyance control for the recording sheet is performed.

Therefore, according to this embodiment, in the case of performing only the monochromatic printing, the conveyance control for the recording sheet is performed using the detection results obtained from the monochrome instead of the detection results obtained from the color. Therefore, the accuracy of the conveyance control for the recording sheet can be increased while the extra consumption of the toner is reduced.

In contrast to this, in the case of performing the detection of the displacement correction pattern using the color, even though only the monochromatic printing is performed, the conveyance control for the recording sheet is performed using the detection results obtained from the color. This results in the extra consumption of color toner.

Further, in the case where the image forming unit in the most upstream side is different for the color image formation and the monochromatic image formation like in the printer of this embodiment, the expansion amount of the intermediate transfer belt over the distance for conveying the color image and the expansion amount of the intermediate transfer belt over the distance for conveying the monochromatic image are different even under the same influence of the temperature change unless the tension roller is disposed. Therefore, in the case of detecting the displacement correction pattern using color only, in order to perform the conveyance control for the recording sheet at the monochromatic printing, the detection results obtained from the color needs to be subjected to predetermined conversion. Therefore, the conveyance control for the recording sheet at the monochromatic printing is less accurate than that at the color printing.

According to this embodiment, in any case of the color and monochromatic printings, the image forming unit in the most upstream side in the image forming process forms the detection timing correction pattern; therefore, the influence of the measurement error from the hardware can be reduced and the accuracy of the image position correction and the conveyance timing correction can be increased further.

According to this embodiment, both the image position correction and the conveyance timing correction are performed using the detection result of the displacement correction pattern; therefore, the extra toner consumption can be reduced.

In this embodiment, if the use of the FC priority mode as a default is assumed, the detection of the displacement correction pattern in the normal mode is mainly performed and in some cases, the printing in the monochromatic mode is performed. Therefore, in the case where the image forming unit in the most upstream side is different in the color image formation and the monochromatic image formation as described in this embodiment, it is preferable to dispose the tension roller so that the expansion amount of the intermediate transfer belt over the distance for conveying the color image and the expansion amount of the intermediate transfer belt over the distance for conveying the monochromatic image are the same value.

Second Embodiment

As described above, in the technique disclosed in Japanese Patent Application Laid-open No. 2008-76534, for example, based on the timing of reading the first set of the displacement correction pattern, the timing of detecting the second and subsequent sets of the displacement correction pattern is decided. Thus, even though the intermediate transfer belt is expanded or contracted, the second set and subsequent sets of the displacement correction patterns can be read surely to perform the image position correction.

Moreover, the difference from the reference value of the detection time of the displacement correction pattern is calculated, and if the conveyance timing correction is performed based on the calculated difference, the conveyance control for the recording sheet considering the expansion or the contraction of the intermediate transfer belt becomes possible.

In this case, the image position correction and the conveyance timing correction are performed commonly using the detection results of the displacement correction pattern; therefore, the timing of executing the both corrections is the same.

Therefore, in the case of an image forming apparatus where the displacement is unlikely to occur, the image position correction is performed less frequently, and accordingly, the conveyance timing correction is performed less frequently. As a result, the execution frequency of the conveyance timing correction is insufficient, resulting in that the expansion and the contraction of the intermediate transfer belt cannot be absorbed in the conveyance control for the recording sheet and the recording sheet may be unable to be conveyed at the appropriate timing.

Here, if the conveyance timing correction is performed more frequently by detecting the displacement correction pattern for the conveyance timing correction independently, it is possible to absorb the expansion and the contraction of the intermediate transfer belt in the conveyance control for the recording sheet; however, in this case, the developer is consumed more.

In view of this, the second embodiment describes an example of increasing the accuracy of the conveyance control for the recording sheet while the consumption of the developer is suppressed. The description below is mainly made of the difference from the first embodiment, and the components having functions similar to those of the first embodiment are omitted.

First, the conveyance timing correction in this second embodiment is described. Note that in the description below, the correction amount is calculated on the premise that the following conditions (1) to (6) are satisfied:

(1) the number of rotations of the photosensitive drum does not change even though the environment changes or the time has passed;
(2) the amount of change in distance from the primary transfer position to the secondary transfer position due to the expansion of the intermediate transfer belt is the same in the case of forming either the color image or the monochromatic image;
(3) the number of rotations of the photosensitive drum does not change in the case of forming either the color image or the monochromatic image;
(4) the linear velocity of the intermediate transfer belt does not change in the case of forming either the color image or the monochromatic image;
(5) the opening or closing of the cover does not change the position of the LEDA exposure; and
(6) the exchange of PCDU does not change the primary transfer position.

In the description below, "the detection of the displacement correction pattern formed in color" may be referred to as "the detection of the displacement correction pattern in the normal mode", "the reference value for the displacement correction pattern formed in color" may be referred to as "the reference value for the normal mode", "the detection timing correction pattern 200-1" may be referred to as "the detection timing correction pattern (Y)R", and "the detection timing correction pattern 200-2" may be referred to as "the detection timing correction pattern (Y)L".

Similarly, in the description below, "the detection of the displacement correction pattern formed in monochrome" may be referred to as "the detection of the displacement correction pattern in the monochromatic mode", "the reference value for the displacement correction pattern formed in monochrome" may be referred to as "the reference value for the monochromatic mode", "the detection timing correction pattern 210-1" may be referred to as "the detection timing correction pattern (B)R", and "the detection timing correction pattern 210-2" may be referred to as "the detection timing correction pattern (B)L".

In the case of the detection of the displacement correction pattern in the normal mode, the CPU 100 calculates the correction amount for the normal mode using Formula (1).

Here, the sampling length d1 is, for example, $0.9961/\alpha$ [μm], and the linear velocity adjustment factor $\alpha$ is, for example, 0.99.

In the case of the detection of the displacement correction pattern in the monochromatic mode, the CPU 100 calculates the correction amount for the normal mode using Formula (2).

When the previous detection of the displacement correction pattern is the detection of the displacement correction pattern in the normal mode, the CPU 100 controls the conveyance timing for the recording sheet to which the color image is transferred, using a value obtained by adding the offset according to the temperature change detected by the temperature and humidity sensor to the correction amount for the normal mode. When the previous detection of the displacement correction pattern is the detection of the displacement correction pattern in the monochromatic mode, the CPU 100 controls the conveyance timing for the recording sheet to which the monochromatic image is transferred, using a value obtained by adding the offset according to the temperature change detected by the temperature and humidity sensor to the correction amount for the monochromatic mode. Note that the temperature sensed by the temperature and humidity sensor may be the temperature inside the apparatus or outside the apparatus.

Specifically, when the previous detection of the displacement correction pattern is the detection of the displacement correction pattern in the normal mode, the CPU 100 calculates the offset ΔToffset using Formula (3), decides the position correction amount ΔP [μm] using Formula (4), and corrects and controls the timing of feeing paper from the paper feeding roller 13 and the timing for conveying the recording sheet by the paper conveyance belt 14 using the decided position correction amount ΔP.

$$\Delta T\text{offset}=(T\text{env}-\text{temperature at the detection of the displacement correction pattern in the normal mode})\times\beta\times\text{Belt [}\mu\text{m]} \quad (3)$$

Here, Tenv is the measurement result (temperature) of the temperature and humidity sensor during the printing, the transfer belt expansion coefficient β is, for example, $0.11\times10^{-3}$ [/° C.] and the entire length of the transfer belt, Belt, is $750\times10^{3}$ [μm], for example.

$$\Delta P=(\text{correction amount for normal mode}+\Delta T\text{offset}) \quad (4)$$

Similarly, if the previous detection of the displacement correction pattern is the detection of the displacement correction pattern in the monochromatic mode, the CPU 100 calculates the offset ΔToffset using Formula (5), decides the position correction amount ΔP using Formula (6), and corrects and controls the timing of feeding paper from the paper feeding roller 13 and the timing for conveying the recording sheet by the paper conveyance belt 14 using the decided position correction amount ΔP.

$$\Delta T\text{offset}=(T\text{env}-\text{temperature at the detection of the displacement correction pattern in the monochromatic mode})\times\beta\times\text{Belt [}\mu\text{m]} \quad (5)$$

$$\Delta P=(\text{correction amount for monochromatic mode}+\Delta T\text{offset}) \quad (6)$$

In this embodiment, the upper-limit and lower-limit values are set in the offset ΔToffset, and if ΔToffset≥1000 [μm], ΔToffset=1000 [μm] and if ΔToffset−1000 [μm], ΔToffset=−1000 [μm].

Note that the position correction amount ΔP is calculated before the start of the page. The temperature at the detection of the displacement correction pattern in the normal mode and the temperature at the detection of the displacement correction pattern in the monochromatic mode are stored in the ROM 102 after the measurement.

Next, the timing of executing the detection of the displacement correction pattern in the second embodiment is described. FIG. 12 is an explanatory view of the timing of executing the detection of the displacement correction pattern in the second embodiment. In this embodiment, basically, the detection of the displacement correction pattern is executed at the power input, at the restoration from the sleep mode, etc., before the start of the job, and after the end of the job;

however, the timing of execution is not limited thereto. For example, the execution may be triggered by temperature change over a certain range.

When the detection of the displacement correction pattern is executed, the image position correction and the conveyance timing correction are performed; in this case, it is not necessary to consider the offset ΔToffset in the conveyance timing correction. In other words, the CPU 100 may calculate the position correction amount ΔP from the correction amount for the normal mode or the correction amount for the monochromatic mode.

For example, it is assumed that the detection of displacement correction pattern in the normal mode is requested in the case of starting the job for the color. In this case, if the mode is the FC priority mode or the Bk priority mode, the CPU 100 executes the detection of the displacement correction pattern in the normal mode before the start of the job for the color.

In addition, it is assumed that the detection of displacement correction pattern in the normal mode is requested in the case of starting the job for the monochrome. In this case, if the mode is the FC priority mode, the CPU 100 executes the detection of the displacement correction pattern in the normal mode before the start of the job for the monochrome.

Further, it is assumed that the detection of displacement correction pattern in the monochromatic mode is requested in the case of starting the job for the monochrome. In this case, if the mode is the Bk priority mode or the color prohibition mode, the CPU 100 executes the detection of the displacement correction pattern in the monochromatic mode before the start of the job for the monochrome.

In FIG. 12, "rest time" starts from the time at which the image forming motor for the image forming unit 16B stops finally. "Detected rest time exceeded threshold" means that one of the following conditions is satisfied: the measurement result from a real-time clock included in the CTL 130 has exceeded 2880 minutes (48 hours); and a timer-up signal is active. "Light detected" is a function of detecting the brightness around the printer with an illuminance sensor, and if a dark state continues for a certain period, determining that there is no one who uses the printer and turning off the power. "SP" is the nonvolatile data stored in the ROM 102 whose control program can be changed depending on the condition or which can be changed in accordance with the state of the image by a service man.

For allowing the users to efficiently use the time other than the downtime, the image position correction is often executed at the end of the job in the general image forming apparatus. In contrast to this, in this embodiment, in order to minimize the situation that the conveyance deviation of the recording sheet is deteriorated without increasing the number of times of executing the image position correction, the image position correction by the detection that the rest time has exceeded the threshold and the image position correction at the end of the job are omitted. The image position correction may be executed at the initialization or the start-up time for fixing.

Figure 13:
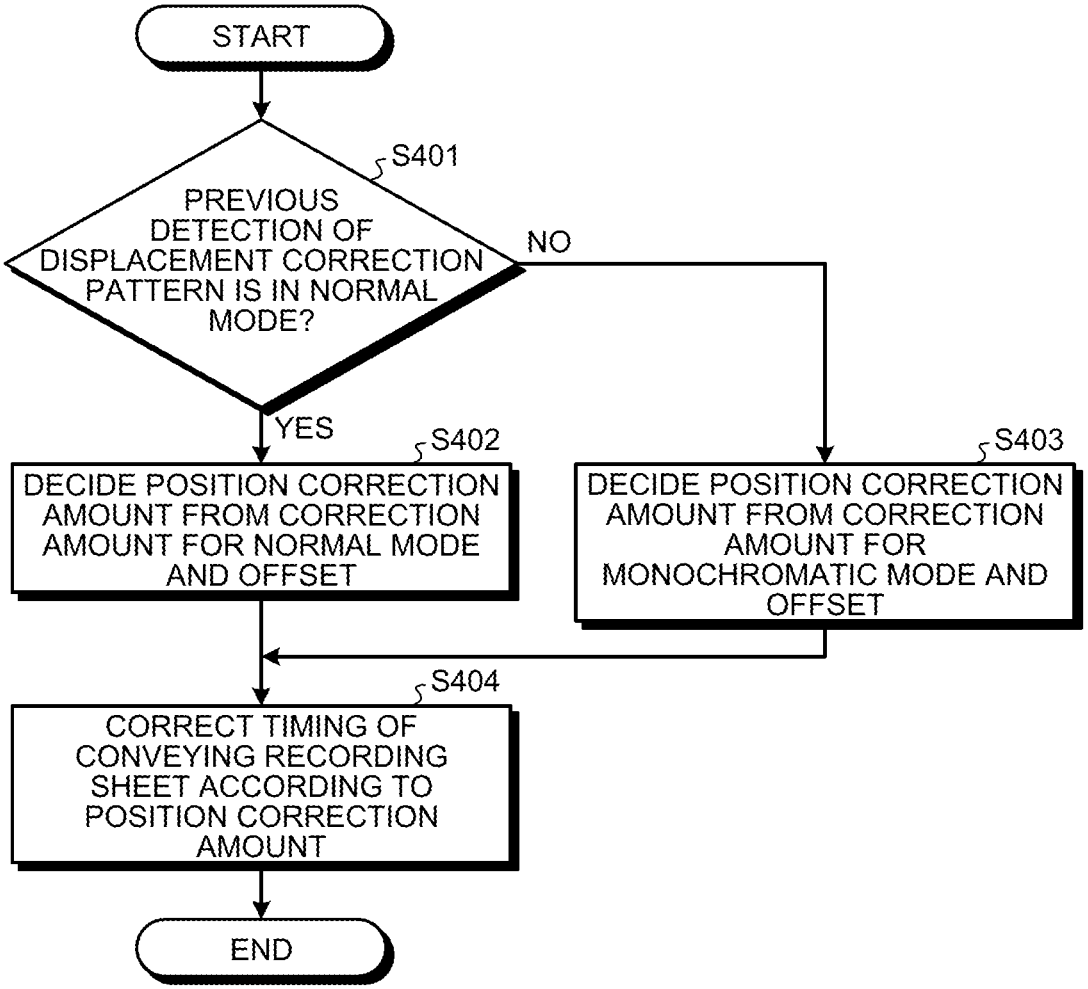
FIG. 13 is a flowchart of an example of a process of correcting the conveyance timing in the second embodiment.

FIG. 13 is a flowchart of an example of a process of the conveyance timing correction in this embodiment.

First, the CPU 100 checks whether or not the previous detection of the displacement correction pattern (image position correction) has been performed in the normal mode (Step S401).

Subsequently, when the mode is the normal mode (Yes in Step S401), the CPU 100 acquires the correction amount for the normal mode from the ROM 102, calculates the offset ΔToffset using Formula (3), and decides the position correction amount ΔP [μm] using Formula (4) (Step S402).

Meanwhile, when the mode is not the normal mode but the monochromatic mode (No in Step S401), the CPU 100 acquires the correction amount for the monochromatic mode from the ROM 102, calculates the offset ΔToffset using Formula (5), and decides the position correction amount ΔP [μm] using Formula (6) (Step S403).

Subsequently, using the decided position correction amount ΔP, the CPU 100 corrects and controls the timing of feeding paper from the paper feeding roller 13 and the timing of conveying the recording paper by the paper conveyance belt 14 (Step S404).

According to this embodiment as above, in the case of not performing the image position correction, the CPU 100 predicts the expansion of the intermediate transfer belt as the offset of the temperature change and performs the conveyance control for the recording sheet. Thus, in this embodiment, the accuracy of the conveyance control for the recording sheet can be increased while the consumption of the developer is suppressed. In particular, in the case of using the LEDA head as the exposing mechanism as described in this embodiment, the displacement due to the temperature change is unlikely to occur, which is more preferable.

Third Embodiment

In the technique disclosed in Japanese Patent Application Laid-open No. 2008-76534, based on the timing of reading the first set of the displacement correction pattern, the timing of detecting the second and subsequent sets of the displacement correction patterns is decided. Thus, even though the intermediate transfer belt is expanded or contracted, the second set and subsequent sets of the displacement correction patterns can be read surely to perform the image position correction.

Moreover, the difference from the reference value of the detection time of the displacement correction pattern is calculated, and if the conveyance timing correction is performed based on the calculated difference, the conveyance control for the recording sheet considering the expansion or the contraction of the intermediate transfer belt becomes possible.

However, the conveyance timing correction described above is merely the correction of the displacement depending on the expansion of the intermediate transfer belt; in general, the conveyance timing for the recording sheet is adjusted at the shipment from the factory so that the image is formed at the correct position on the recording sheet or adjusted by the setting of the adjustment value in the user adjustment and the service adjustment, etc.

Here, in the case where the image forming unit to be used is different depending on the content of the image to be formed, the timing of conveying the recording sheet is preferably adjusted so that the image is formed at the correct position on the recording sheet for any content of the image to be formed.

However, in some cases, it is difficult to adjust the timing of conveying the recording sheet for every content of the image to be formed. In those cases, even though the conveyance timing correction is performed as above in the image formation with the content of the image to be formed in which the timing of conveying the recording sheet is not adjusted, the image cannot be formed at the correct position on the recording sheet.

In view of this, in the third embodiment, an example of forming the image at the correct position on the recording sheet is described. The description is mainly made of the difference from the first embodiment, and the components having the similar functions to those of the first embodiment are omitted.

The conveyance timing correction of the third embodiment is described. Note that in the description below, the correction amount is calculated on the premise that the following conditions (1) to (6) are satisfied:

(1) the number of rotations of the photosensitive drum does not change even though the environment changes or the time has passed;
(2) the amount of change in distance from the primary transfer position to the secondary transfer position due to the expansion of the intermediate transfer belt is the same in the case of forming either the color image or the monochromatic image;
(3) the number of rotations of the photosensitive drum does not change in the case of forming either the color image or the monochromatic image;
(4) the linear velocity of the intermediate transfer belt does not change in the case of forming either the color image or the monochromatic image;
(5) the opening or closing of the cover does not change the position of the LEDA exposure; and
(6) the exchange of PCDU does not change the primary transfer position.

In the description below, "the detection of the displacement correction pattern formed in color" may be referred to as "the detection of the displacement correction pattern in the normal mode", "the reference value for the displacement correction pattern formed in color" may be referred to as "the reference value for the normal mode", "the detection timing correction pattern 200-1" may be referred to as "the detection timing correction pattern (Y)R", and "the detection timing correction pattern 200-2" may be referred to as "the detection timing correction pattern (Y)L".

Similarly, in the description below, "the detection of the displacement correction pattern formed in monochrome" may be referred to as "the detection of the displacement correction pattern in the monochromatic mode", "the reference value for the displacement correction pattern formed in monochrome" may be referred to as "the reference value for the monochromatic mode", "the detection timing correction pattern 210-1" may be referred to as "the detection timing correction pattern (B)R", and "the detection timing correction pattern 210-2" may be referred to as "the detection timing correction pattern (B)L".

In the case of the detection of the displacement correction pattern in the normal mode, the CPU 100 calculates the correction amount for the normal mode using Formula (1).

In the case of the detection of the displacement correction pattern in the monochromatic mode, the CPU 100 calculates the correction amount for the monochromatic mode using Formula (2).

The CPU 100 then refers to the position adjustment information that represents for which one of the color image formation and the monochromatic image formation the position adjustment on the recording sheet has been performed. The position adjustment information may include the position adjustment amount. The position adjustment information is updated in the ROM 102 upon the position adjustment at the shipment from the factory, the assurance step, the user adjustment, or the service adjustment.

However, in the case where the reference value for the normal mode or the reference value for the monochromatic mode is measured again and updated by the user or the service man, the position adjustment is preferably performed as continuously as possible at the normal temperature and normal humidity and normal temperature in the apparatus.

If the position adjustment information represents the position adjustment performed on the recording sheet relative to the color image formation, the CPU 100 controls the timing of conveying the recording sheet to which the color image is transferred, using the correction amount for the normal mode, and controls the timing of conveying the recording sheet to which the monochromatic image is transferred, using the value obtained by correcting the correction amount for the monochromatic mode with the value based on the difference between the second reference value and the first reference value.

When the position adjustment information represents the position adjustment performed on the recording sheet relative to the monochromatic image formation, the CPU 100 controls the timing of conveying the recording sheet to which the color image is transferred, using the value obtained by correcting the correction amount for the normal mode with the value based on the difference between the first reference value and the second reference value, and controls the timing of conveying the recording sheet to which the monochromatic image is transferred, using the correction amount for the monochromatic mode.

Note that in this embodiment, it is assumed that the position adjustment information represents the position adjustment performed on the recording sheet relative to the color image formation. This is because, in some apparatus designs, in the case of printing a color image, the monochromatic image will not be printed in a state that the photosensitive drums 17C, 17M, and 17Y are separated from the intermediate transfer belt 22 but in the case of printing a monochromatic image, the color image with only the monochromatic component may be printed in a state that the photosensitive drums 17C, 17M, and 17Y are in contact with the intermediate transfer belt 22. Therefore, the detailed description is made of the case where the position adjustment information represents the position adjustment performed on the recording sheet relative to the color image formation.

In this case, in the case of performing the color image formation, the CPU 100 decides the position correction amount ΔP [μm] from the correction amount for the normal mode, and using the position correction amount ΔP, the CPU 100 corrects and controls the timing of feeding paper from the paper feeding roller 13 and the timing of conveying the recording sheet by the paper conveyance belt 14. On the other hand, in the case of performing the monochromatic image formation, the CPU 100 decides the position correction amount ΔP [μm] from the correction amount for the monochromatic mode, and using Formula (7), the CPU 100 updates the position correction amount ΔP and using the updated position correction amount ΔPupdated, the CPU 100 corrects and controls the timing of feeding paper from the paper feeding roller 13 and the timing of conveying the recording sheet by the paper conveyance belt 14.

$$\Delta P\text{updated} = \Delta P + \{\text{reference value for the monochromatic mode} - \text{reference value for the normal mode}\} \times \text{sampling length } d1\ [\mu m] \quad (7)$$

Here, the sampling length d1 is, for example, 0.9961/α [μm], and α (linear velocity adjustment factor) is, for example, 0.99.

Note that the position correction amount ΔP is calculated before the start of the page. In this embodiment, the position correction amount ΔP is updated when the monochromatic image formation is performed. However, in order to effectively updating the position correction amount ΔP, i.e., to form the monochromatic image at the correct position on the recording sheet, it is necessary, as the premise condition, to detect the displacement amount of the color image relative to the recording sheet in the assurance step, user adjustment, or service adjustment and to update the adjustment value so that the image is formed at the correct position on the recording sheet.

Figure 14:
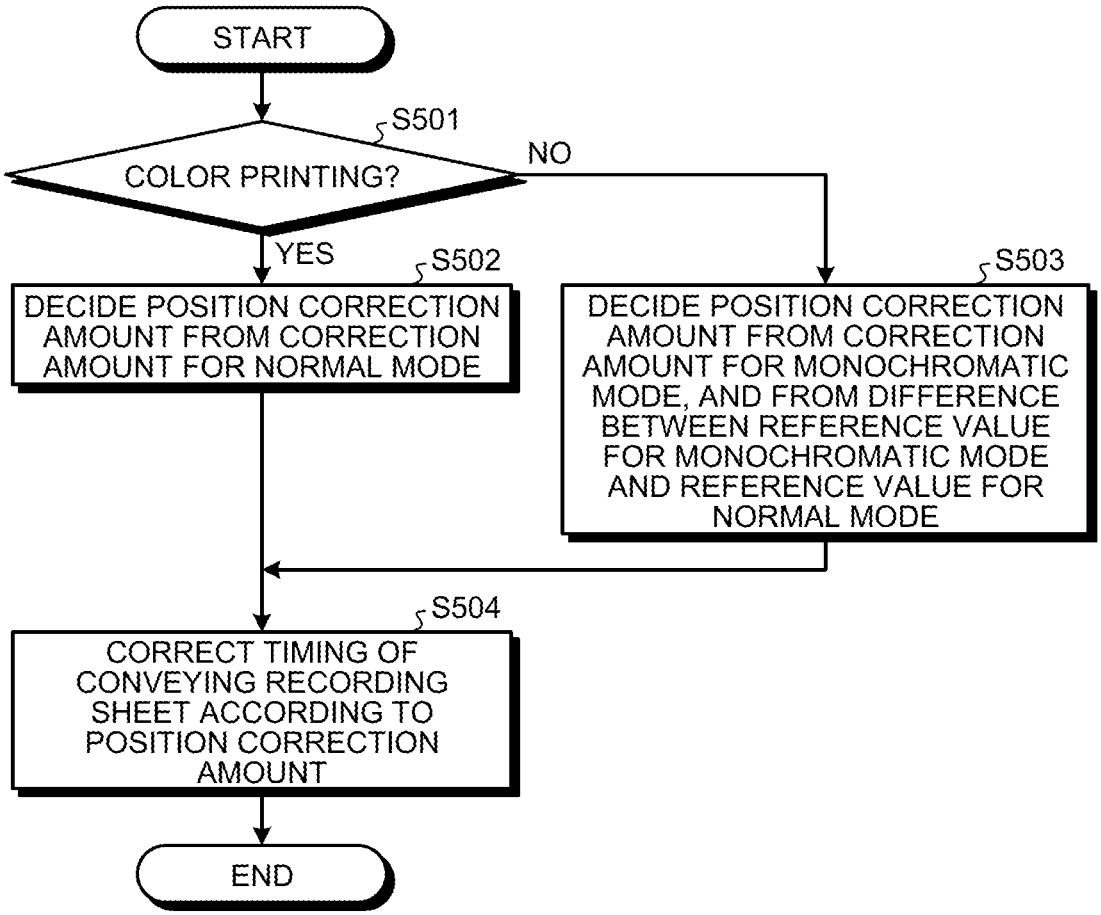
FIG. 14 is a flowchart of an example of a process of correcting the conveyance timing in a third embodiment.

FIG. 14 is a flowchart of an example of a process of correcting the conveyance timing in this embodiment. The process shown in FIG. 14 is performed before the start of the page.

First, in the case of performing color printing (Yes in Step S501), since the position adjustment information represents that the position adjustment on the recording sheet has been performed relative to the color image formation, the CPU 100 acquires the correction amount for the normal mode from the ROM 102 and decides the position correction amount ΔP (Step S502).

Meanwhile, in the case of performing monochromatic printing (No in Step S501), since the position adjustment information represents that the position adjustment on the recording sheet has been performed relative to the color image formation, the CPU 100 acquires the correction amount for the monochromatic mode from the ROM 102 and decides the position correction amount ΔP and further updates the position correction amount ΔP using Formula (7) (Step S503).

Subsequently, the CPU 100 corrects and controls the timing of feeding paper from the paper feeding roller 13 and the timing of conveying the recording sheet by the paper conveyance belt 14 using the decided or updated position correction amount ΔP (Step S504).

As described above, in this embodiment, even though the displacement amount of the image relative to the recording sheet is adjusted for the color only, the timing difference between the color and the monochrome can be absorbed using the difference between the second reference value and the first reference value; thus, the monochromatic image can be formed at the correct position on the recording sheet.

Further, even though the displacement amount of the image relative to the recording sheet is adjusted for the monochrome only, the color image can be formed at the correct position on the recording sheet similarly.

According to this embodiment, in any case of the color and monochrome, the image forming unit in the most upstream side in the image forming process forms the detection timing correction pattern; therefore, the influence of the measurement error from the hardware can be reduced and the accuracy of the image position correction and the conveyance timing correction can be increased further.

MODIFIED EXAMPLE

The present invention is not limited to the above embodiments, and various modifications are possible. In the above embodiment, the exposure mechanism is formed using the LEDA head as a solid-state scanning type writing device; however, the exposure mechanism may be formed using another solid-state scanning type writing device such as an organic EL (electroluminescence) head, an LD (laser diode) array head, or a surface emission laser. Those devices are also preferable as aforementioned, and since a unit type optical system as the LD writing device is not used in the solid-state scanning type writing device, the displacement of image transfer position easily occurs randomly for each image forming unit; thus, those are particularly preferable in the present invention.

However, the exposure mechanism is not limited to the solid-state scanning type writing device but may be a scanning type writing device including a unit type optical system. This is because, even if the scanning type writing device is used in the exposure mechanism, the displacement of the image transfer position is not necessarily prevented in the image forming unit.

Although the above embodiments have described the example in which the intermediate transfer belt is extended, the present invention is similarly applicable to the case where the intermediate transfer belt is contracted.

According to the present invention, an effect of increasing the accuracy of the conveyance control of the recording sheet while reducing the extra consumption of a developer can be obtained.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a plurality of image forming units configured to form an image in different colors;

a conveyance mechanism configured to convey a first pattern formed using at least a first image forming unit of the plurality of image forming units, that forms the image in a first color, and to convey a second pattern formed using a second image forming unit of the plurality of image forming units, that forms the image in a second color;

a detection unit configured to detect the first pattern conveyed by the conveyance mechanism and the second pattern conveyed by the conveyance mechanism; and a control unit configured to control, when a first condition is satisfied, a timing of conveying a recording sheet to which the image formed using at least the first image forming unit is transferred on the basis of a first time required after the formation of the first pattern and before the detection of the first pattern by the detection unit, the control unit being further configured to control, when a second condition is satisfied, a timing of conveying the recording sheet to which the image formed using the second image forming unit is transferred on the basis of a second time required after the formation of the second pattern and before the detection of the second pattern by the detection unit, the first condition being satisfied upon a mode of the image forming apparatus being in a priority mode prioritizing color image formation, or a mode of the image forming apparatus being in either a priority mode prioritizing monochromatic image formation or in a color prohibition mode prohibiting color image formation, wherein a previously imaged pattern is the first pattern, and the second condition being satisfied upon a mode of image forming apparatus being in either the priority mode prioritizing monochromatic image formation or in the color prohibition mode prohibiting color image formation, wherein a previously imaged pattern is the second pattern.

2. The image forming apparatus according to claim 1, further comprising a storage unit configured to store a first reference value as a reference value of the first time and a second reference value as a reference value of the second time, wherein the control unit controls, when the first condition is satisfied, the timing of conveying the recording sheet on the basis of a difference between the first time and the first reference value, and the control unit controls, when the second condition is satisfied, the timing of conveying the recording sheet on the basis of a difference between the second time and the second reference value.

3. The image forming apparatus according to claim 1, wherein the first color is a color other than black used in color image formation, the second color is black, the first image forming unit is an image forming unit located in the most upstream side of a conveying direction of the conveyance mechanism among the image forming units for performing color image formation in the image forming units, and the second image forming unit is an image forming unit located in the most upstream side of the conveying direction of the conveyance mechanism among the image forming units for performing monochromatic image formation in the image forming units.

4. The image forming apparatus according to claim 3, wherein the first pattern is formed using the image forming unit performing color image formation, of the plurality of image forming units, the second pattern is formed using the image forming unit performing monochromatic image formation, of the plurality of image forming units, and the control unit is configured to control an exposure timing for the image forming unit performing color image formation using a detection result of the first pattern from the detection unit, and is configured to control an exposure timing for the image forming unit performing monochrome image formation using a detection result of the second pattern from the detection unit.

5. The image forming apparatus according to claim 1, further comprising a buffer mechanism configured to absorb expansion and contraction of the conveyance mechanism, wherein the buffer mechanism is provided between the image forming unit located in the most downstream side of a conveying direction of the conveyance mechanism and the detection unit.

6. An image forming apparatus comprising:

a plurality of image forming units configured to form an image in different colors;

a conveyance mechanism configured to convey a first pattern formed using at least a first image forming unit among the image forming units, that forms the image in a first color, and convey a second pattern formed using a second image forming unit among the image forming units, that forms the image in a second color;

a detection unit configured to detect the first pattern conveyed by the conveyance mechanism and the second pattern conveyed by the conveyance mechanism;

a storage unit configured to store a first temperature at the detection of the first pattern and a second temperature at the detection of the second pattern; and a control unit configured to control, when the first pattern has been previously detected, a timing of conveying a recording sheet to which the image formed using at least the first image forming unit is transferred on the basis of a first time required after the formation of the first pattern and before the detection of the first pattern by the detection unit, the first temperature, and a current temperature, and the control unit configured to control, when the second pattern has been previously detected, a timing of conveying the recording sheet to which the image formed using the second image forming unit is transferred on the basis of a second time required after the formation of the second pattern and before the detection of the second pattern by the detection unit, the second temperature, and the current temperature.

7. The image forming apparatus according to claim 6, wherein the storage unit further stores a first reference value as a reference value of the first time and a second reference value as a reference value of the second time, and the control unit controls, when the first pattern has been previously detected, the timing of conveying the recording sheet to which the image formed by using at least the first image forming unit is transferred on the basis of a value obtained by adding a value based on a difference between the first temperature and the current temperature to a value based on a difference between the first time and the first reference value, and the control unit controls, when the second pattern has been previously detected, the timing of conveying the recording sheet to which the image formed by using the second image forming unit is transferred on the basis of a value obtained by adding a value based on a difference between the second temperature and the current temperature to a value based on a difference between the second time and the second reference value.

8. The image forming apparatus according to claim 6, wherein the first temperature, the second temperature, and the current temperature are temperatures inside or outside the apparatus.

9. The image forming apparatus according to claim 6, wherein the first color is a color other than black used in color image formation, the second color is black, the first image forming unit is an image forming unit located in the most upstream side of a conveying direction of the conveyance mechanism among the image forming units for performing color image formation in the image forming units, and the second image forming unit is an image forming unit located in the most upstream side of a conveying direction of the conveyance mechanism among the image forming units for performing monochromatic image formation in the image forming units.

10. The image forming apparatus according to claim 9, wherein the first pattern is formed using the image forming unit performing color image formation, of the plurality of image forming units, the second pattern is formed using the image forming unit performing monochromatic image formation, of the plurality of image forming units, and the control unit is configured to control an exposure timing for the color using a detection result of the first pattern from the detection unit, and is configured to control an exposure timing for the monochrome using a detection result of the second pattern from the detection unit.

11. The image forming apparatus according to claim 10, wherein the control unit is configured to correct an image position by controlling the exposure timing when temperature has changed over a certain range or a power-off time has continued for a certain period.

12. The image forming apparatus according to claim 11, further comprising a controller, wherein the power-off time is configured to be measured using a real-time clock included in the controller or an active timer-up signal output from the controller.

13. The image forming apparatus according to claim 12, wherein the power-off time is configured to be measured from a time when a driving motor for the image forming unit performing the monochromatic image formation stops finally.

14. The image forming apparatus according to claim 10, wherein the control unit is configured to correct an image position by controlling the exposure timing at initialization or start-up for fixing.

15. An image forming apparatus comprising:

a plurality of image forming units configured to form an image in different colors;

a conveyance mechanism configured to convey a first pattern formed using at least a first image forming unit among the image forming units, that forms the image in a first color, and convey a second pattern formed using a second image forming unit among the image forming units, that forms the image in a second color;

a detection unit configured to detect the first pattern conveyed by the conveyance mechanism and detecting the second pattern conveyed by the conveyance mechanism;

a storage unit configured to store therein position adjustment information representing for which one of the first image and the second image position adjustment on a recording sheet has been performed, a first reference value as a reference value of a first time required after the image formation of the first pattern and before the detection of the first pattern by the detection unit, and a second reference value as a reference value of a second time required after the image formation of the second pattern and before the detection of the second pattern by the detection unit; and a control unit configured to control, when the position adjustment information represents that the position adjustment for the first image on the recording sheet has been performed, a timing of conveying the recording sheet to which the image formed by the first image forming unit is transferred on the basis of the first time and the first reference value and controlling a timing of conveying the recording sheet to which the image formed by the second image forming unit is transferred on the basis of the second time, the first reference value, and the second reference value, and the control unit configured to control, when the position adjustment information represents that the position adjustment for the second image on the recording sheet has been performed, a timing of conveying the recording sheet to which the image formed by the first image forming unit is transferred on the basis of the first time, the first reference value, and the second reference value and controlling a timing of conveying the recording sheet to which the image formed by the second image forming unit is transferred on the basis of the second time and the second reference value.

16. The image forming apparatus according to claim 15, wherein the control unit controls, when the position adjustment information represents that the position adjustment for the first image on the recording sheet has been performed, the timing of conveying the recording sheet to which the image formed by the first image forming unit is transferred on the basis of a difference between the first time and the first reference value and the timing of conveying the recording sheet to which the image formed by the second image forming unit is transferred on the basis of a value obtained by adding a value based on a difference between the second reference value and the first reference value to a value obtained based on a difference between the second time and the second reference value, and the control unit controls, when the position adjustment information represents that the position adjustment for the second image on the recording sheet has been performed, the timing of conveying the recording sheet to which the image formed by the first image forming unit is transferred on the basis of a value obtained by adding a value based on a difference between the first reference value and the second reference value to a value based on a difference between the first time and the first reference value and the timing of conveying the recording sheet to which the image formed by the second image forming unit is transferred on the basis of a difference between the second time and the second reference value.

17. The image forming apparatus according to claim 15, wherein the first color is a color other than black used in color image formation, the second color is black, the first image is a color image, the second image is a monochromatic image, the first image forming unit is an image forming unit located in the most upstream side of a conveying direction of the conveyance mechanism among the image forming units performing color image formation in the image forming units, and the second image forming unit is an image forming unit located in the most upstream side of a conveying direction of the conveyance mechanism among the image forming units performing monochromatic image formation in the image forming units.

18. The image forming apparatus according to claim 17, wherein the first pattern is formed using the image forming units performing color image formation among the image forming units, the second pattern is formed using the image forming unit performing monochromatic image formation among the image forming units, and the control unit controls an exposure timing for the color using a detection result of the first pattern from the detection unit, and controls an exposure timing for the monochrome using a detection result of the second pattern from the detection unit.

19. The image forming apparatus according to claim 15, wherein the position adjustment information represents that the position adjustment for the first image on the recording sheet has been performed.

20. The image forming apparatus according to claim 15, wherein the position adjustment is performed when the first reference value or the second reference value is updated.

* * * * *